US007712520B1

(12) United States Patent
Hettes

(10) Patent No.: US 7,712,520 B1
(45) Date of Patent: May 11, 2010

(54) BRUSH FOR A WELL BORE CASING

(75) Inventor: Frank Hettes, Greentown, PA (US)

(73) Assignee: Weiler Corporation, Cresco, PA (US)

( * ) Notice: Subject to any disclaimer, the term of this patent is extended or adjusted under 35 U.S.C. 154(b) by 0 days.

(21) Appl. No.: 12/288,514

(22) Filed: Oct. 21, 2008

(51) Int. Cl.
*E21B 37/00* (2006.01)

(52) U.S. Cl. ..... 166/173

(58) Field of Classification Search ..... 166/170, 166/173

See application file for complete search history.

(56) References Cited

U.S. PATENT DOCUMENTS

| | | | | |
|---|---|---|---|---|
| 83,607 | A * | 11/1868 | Coyle | 15/104.2 |
| 2,215,514 | A | 9/1940 | MacGregor | |
| 2,628,682 | A | 2/1953 | Wright | |
| 2,802,536 | A * | 8/1957 | Baker | 166/173 |
| 3,176,772 | A | 4/1965 | MacGregor | |
| 5,829,521 | A * | 11/1998 | Brown, Jr. | 166/173 |
| 6,227,291 | B1 * | 5/2001 | Carmichael et al. | 166/170 |
| 6,575,239 | B2 * | 6/2003 | Allen | 166/170 |
| 6,745,839 | B1 * | 6/2004 | Simpson | 166/311 |

FOREIGN PATENT DOCUMENTS

| | | |
|---|---|---|
| GB | 2 334 541 | 8/1999 |
| GB | 2 411 919 | 9/2005 |
| GB | 2 429 723 | 3/2007 |

OTHER PUBLICATIONS

RuffBrush™ Debris Removal Tool; BJ Services Company; Apr. 11, 2006, 1 sheet.

Tough Boy™ Riser Brush Tool; Bilco Tools, Inc.; Tough Boy™Brush Tools; http://www.bilcotools.com/'BrushTool.html; May 13, 2008; pp. 1-3.

* cited by examiner

*Primary Examiner*—Daniel P Stephenson
(74) *Attorney, Agent, or Firm*—Drinker Biddler & Reath LLP

(57) ABSTRACT

A brush for cleaning debris from the inner surface of a well bore casing. The brush includes an inner base ring adapted to fit on a shaft, and at least one bristle assembly engaged around the circumference of the base ring. The brush features wire bristles extending radially from its circumference forming a brushing surface, and at least one channel formed in the brushing surface to provide for the evacuation of loosened debris.

19 Claims, 5 Drawing Sheets

BRUSH FOR A WELL BORE CASING

FIELD OF THE INVENTION

The present invention relates generally to brushes, and particularly, to brushes for cleaning the interior surfaces of well bore casings.

BACKGROUND OF THE INVENTION

When a bore is created by drilling equipment, a casing is typically inserted into the well to reinforce the sides and to provide a secure conduit for equipment and debris. The interior wall of the casing must be kept free of dirt and debris in order to ensure the smooth passage of equipment and exiting debris. After a well is completed, tools must be inserted to check various aspects of the well. These tools often include a brushing tool to clean the inside surface of the casing and remove debris. Because of the harsh environment in which these brushes must operate, the bristle material must be tough and resilient, yet efficient at removing and evacuating debris. These brushes typically include numerous welds to retain the various brush components. In use, these welds have a high failure rate, which causes the brush to fail, potentially damaging the well bore.

Existing designs typically use either steel or nylon brush elements. Common designs include plug-type or row-type inserts. Plug-type inserts generally feature cylindrically-shaped bristle modules that may be inserted into a base piece mounted on a shaft extending through the well bore; see, for example, U.S. Pat. No. 3,176,772. The inserts may be arranged in a spiral pattern around the shaft circumference. Row-type inserts commonly feature several rows of bristles on a base piece that may be mounted to a shaft extending through the well bore. The rows are generally arranged in an angled parallel arrangement around the circumference of the shaft. These designs, however, suffer from several deficiencies. First, the relatively small number of bristles in these designs decreases the brushes' cleaning ability, and the relatively large space between inserts reduces the brushes' ability to evacuate loose debris. Second, the use of multiple bristle inserts increases the time and labor required to replace the bristles. Third, existing designs commonly use carbon steel or nylon bristles, which do not withstand the harsh environment inside the well bore casing for very long. Finally, existing designs are constructed by bonding or crimping individual bristles to the base piece, resulting in the loss of bristles as the brush operates.

A need, therefore, exists for a well bore casing brush that efficiently removes and evacuates debris, is easy to replace, and holds up to the conditions inside the well bore casing.

SUMMARY OF THE INVENTION

The invention is directed to a brush for cleaning the inside of a well bore casing. The brush includes a cylindrical base piece, circular retaining members that secure the bristles in a bristle assembly, and channels formed through the bristle assembly to provide an evacuation path for loose debris. The components of the brush are preferably made from stainless steel to resist corrosion. The brush design eliminates the need for structural welds. All structural components are created from solid material, eliminating the possibility of brush failure. The brush is incorporated into the well bore checking tools and is inserted into the well as part of the tools.

Other objects, aspects and advantages of the present invention will become apparent to those skilled in the art upon reading the following detailed description, when considered in conjunction with the appended claims and the accompanying drawings briefly described below.

BRIEF DESCRIPTION OF THE DRAWINGS

For the purpose of illustrating the invention, there are shown in the drawings embodiments that are presently preferred; it being understood, however, that this invention is not limited to the precise arrangements and constructions particularly shown. In the drawings.

DETAILED DESCRIPTION OF THE PREFERRED EMBODIMENTS

Figure 1:
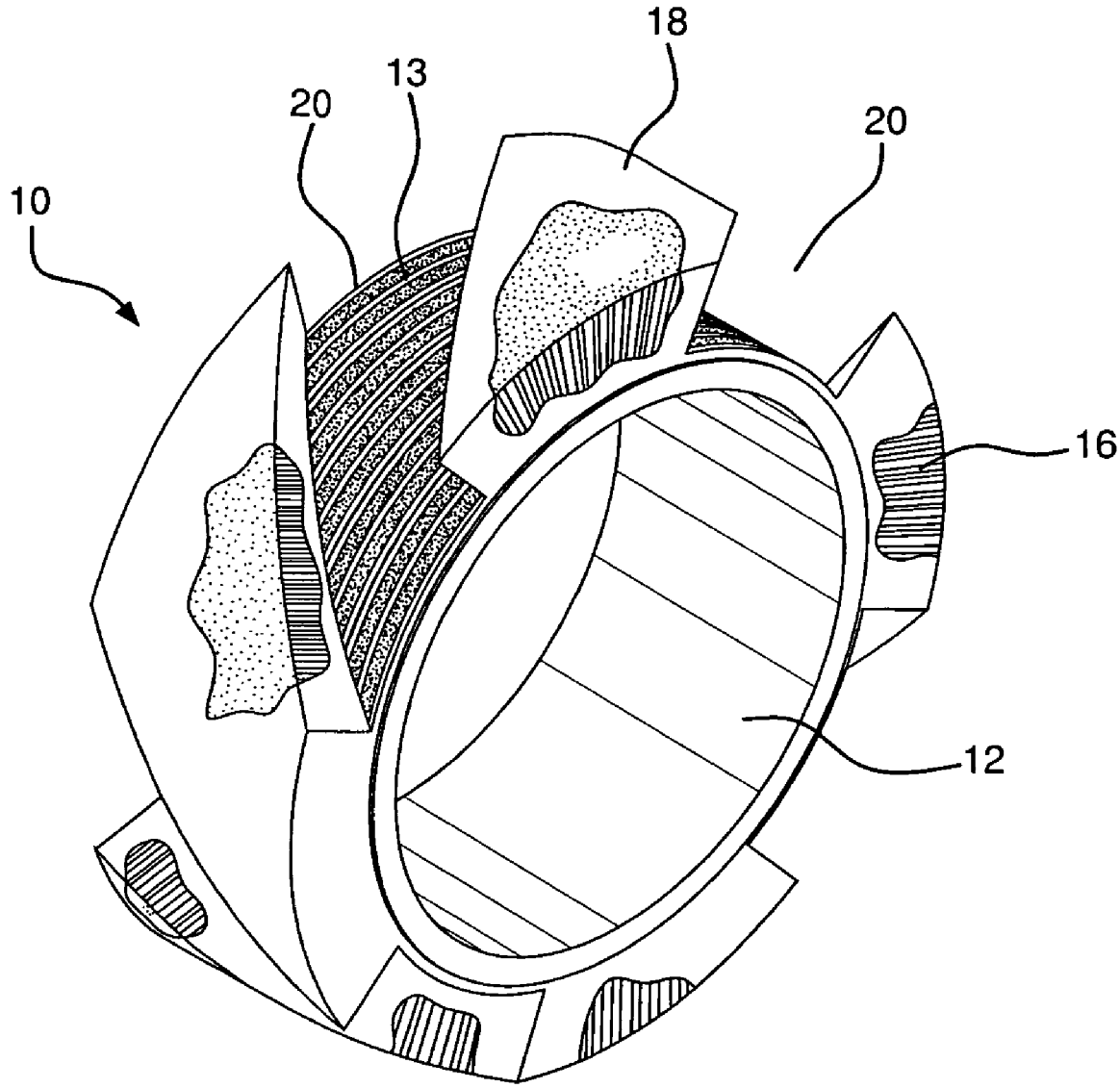
FIG. 1 is an isometric view of an embodiment of the brush of the present invention.

Referring now to the drawings, which illustrate several preferred embodiments of the invention, a brush for a well bore casing is shown. As will be discussed in more detail below, the brush preferably includes an inner base ring, at least one bristle assembly circumscribing the outer surface of the base ring, and bristles held in place by the retaining members, forming a brushing area.

Figure 3:
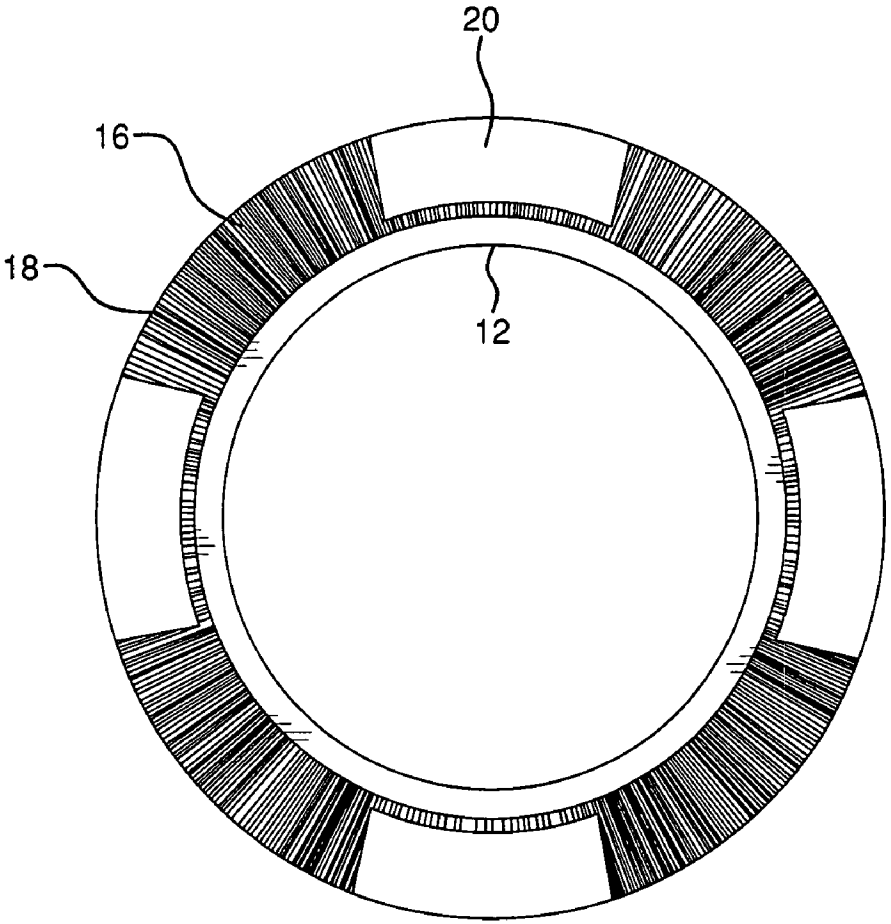
FIG. 3 is a top view of the brush of FIG. 1.

FIG. 1 is an isometric view of a brush 10 according to one embodiment of the invention. The brush includes a base ring 12, bristle assemblies 13, and bristles 16. As seen in the figure, the bristles form a brushing surface 18, which is substantially continuous across the width of the brush. (For simplicity, only a portion of the bristles are shown in the drawings.) The bristles extend generally radially from the circumference of the base ring as shown in FIG. 3. While the brushing surface may feature any bristle density, the bristles are preferably arranged so that each square inch of brushing surface contains between approximately 300 bristles and 1500 bristles.

Figure 2:
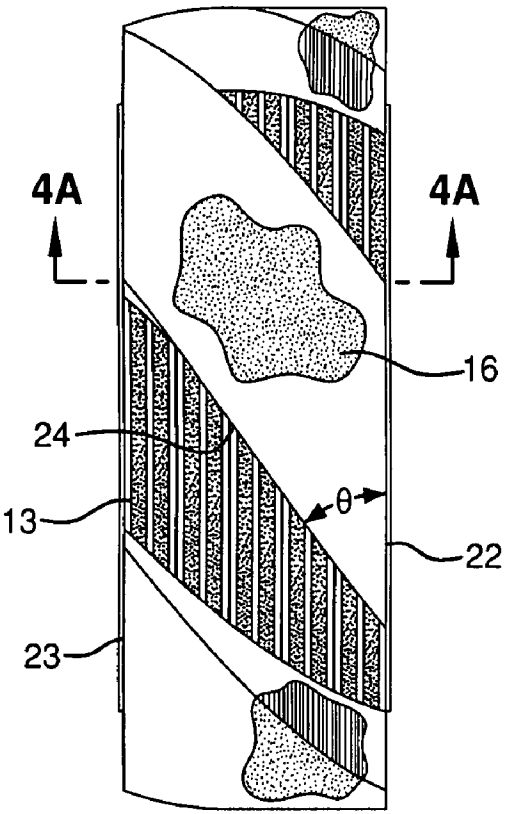
FIG. 2 is a side view of the brush of FIG. 1.

The brushing surface has at least one channel 20 formed through it. The channel 20 extends through the width of the brushing surface from a front face or edge 22 to a rear face or edge 23, and preferably extends in a path non-perpendicular to the front face 22. In one embodiment, the channel 20 has the shape of a parallelogram extending helically around the circumference of the brush. As seen in FIG. 2, the angle $\theta$ between the front face 22 of the brush and the wall 24 of the channel is preferably approximately 30 degrees, although one of ordinary skill will recognize that any angle greater than 0 degrees and less than 90 degrees may be used and would preferably be selected so as to correspond with the anticipated rotation of the tool string to which it will be attached so that debris removed by the bristles move freely though the channels. Also as seen in FIG. 2, in one embodiment of the brush, the channel is oriented so that there is no straight path extending from the front face to the rear face. In the illustrated embodiment, the channels preferably take up approximately 40% of the circumference of the brush, i.e., 140-150 degrees of the brush circumference. However, it should be readily apparent that the channels may be more or less than the illustrated embodiment. The width of the brush is preferably about 3 inches.

Figure 4A:
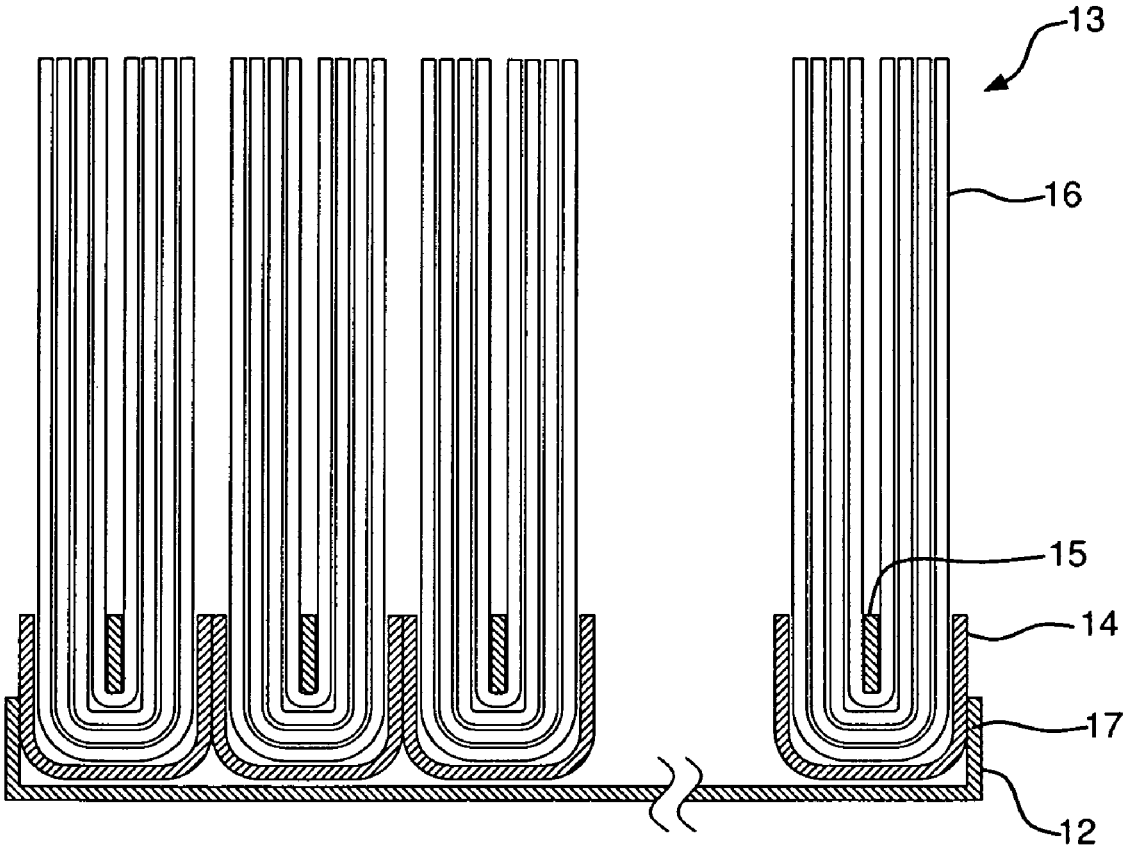
FIG. 4A is an enlarged cross-section of the brush of FIG. 2, seen along line 4A-4A.
Figure 4B:
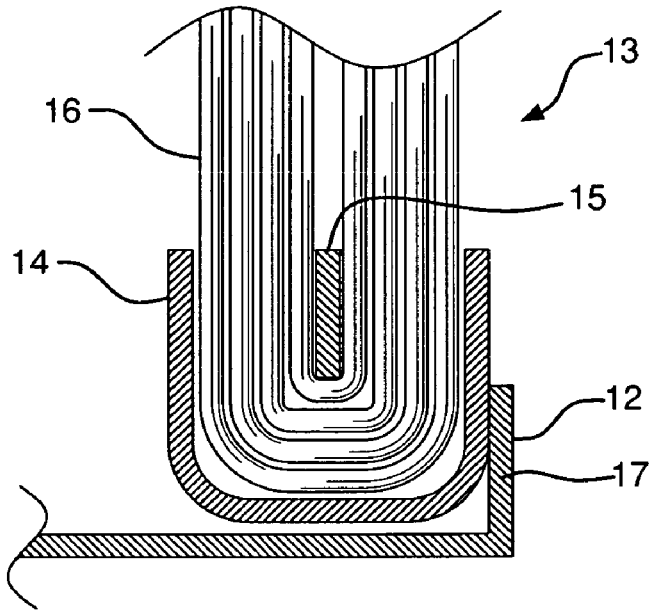
FIG. 4B is an enlarged view of a portion of the cross-section of FIG. 4A.
Figure 4C:
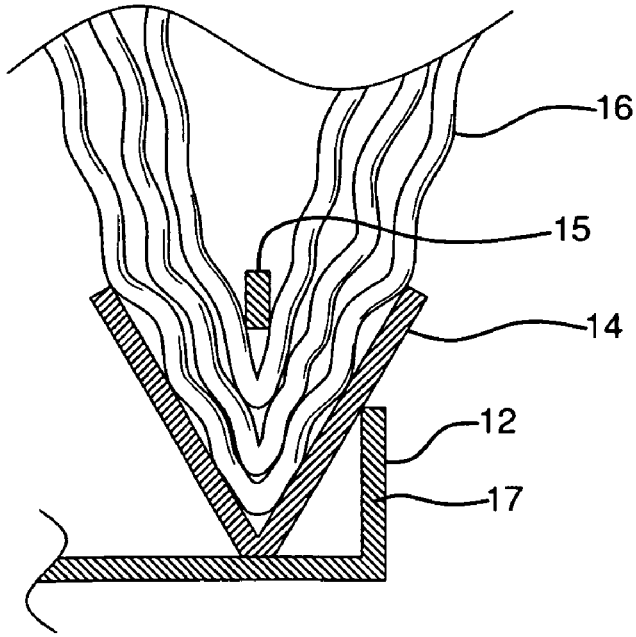
FIG. 4C is an enlarged view of a second embodiment of the brush of FIG. 4A.

As shown in FIGS. 4A and 4B, the bristles are held in a plurality of bristle rings 13. Each bristle ring includes an inner retaining member 14 and a retaining ring 15. The channel shape of the inner member and location of the retaining ring force the bristles into the approximate U- or V-shape as shown in FIGS. 4A, 4B, and 4C. The bristles are wrapped around the ring 15 as shown such that the ring retains the bristles in the inner member 14. By securing the bristles in this manner, the bristles are less likely the break free. The bristles are retained by the inner member and the retaining ring. This eliminates the need for bonding the bristles in place. Because each bristle is held at the approximate center of its length, rather than at one end, the bristles do not easily dislodge from the brush during use. As shown in FIG. 4C, the inner retaining member may be crimped against the bristles to further secure the bristles in place. As shown in FIG. 4A, the brush 10 is preferably an assembly of multiple bristle rings 13 attached to the base ring 12. While the bristle rings preferably feature a single row (i.e., have a U- or V-shaped cross-section as shown in FIGS. 4B and 4C), they may also feature multiple rows of bristles, e.g., a W-shaped cross-section (not shown).

The bristles, like the inner retaining member, retaining ring, and base ring, may be made of any number of materials, but are preferably made from stainless steel for strength and corrosion resistance. The bristles are preferably made from wire with a diameter of approximately 0.010 to 0.035 inch. However, one of ordinary skill in the art will realize that the bristle diameter may be changed to create either stiffer or more flexible bristles; the thicker the wire, the stiffer the bristles will be. Also, the density of the bristles will impact the overall stiffness of the brush. Thus, the bristle density can be controlled so as to vary the stiffness of the brush depending on the anticipated use.

The brush is intended to occupy the space between the tools and the inner surface of the well bore casing. Thus, the length of the bristles will depend essentially on the difference between the diameter of the well bore casing and the diameter of the tools. The bristles preferably have a length so that the diameter of the brush (defined by the radial ends of the bristles) is slightly greater than the inner diameter of the well bore casing. One of ordinary skill in the art will realize that the bristle length will have an effect on the effectiveness of the bristles; longer bristles will deform more easily but will provide a deep channel through which to evacuate debris; shorter bristles will be more rigid and will provide more effective cleaning, but a correspondingly shallower channel. In a preferred embodiment, the bristles extend approximately one inch from the base of the bristle ring; that is, the bristles are preferably formed from wire segments approximately 2 inches long.

Figure 5:
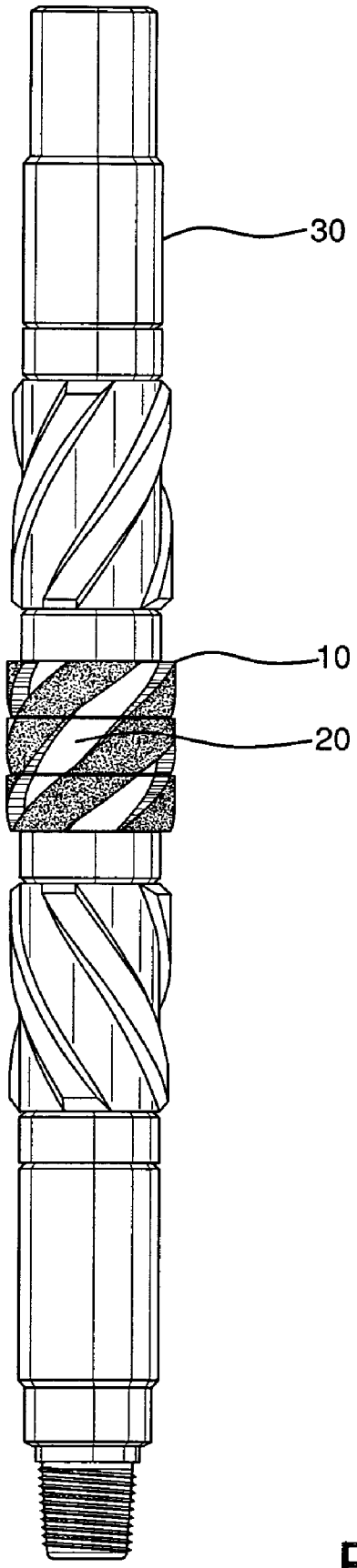
FIG. 5 is a side view of a drill shaft featuring multiple brushes according to FIG. 1 attached thereto.

The brush is installed on the tools 30 as shown in FIG. 5. It is preferable that multiple brushes are installed on the shaft adjacent to one another as shown. When using multiple brushes, the brushes are arranged so as to align the channels on each brush with corresponding channels on the adjacent brush. This alignment creates a continuous pathway for the evacuation of loose debris. As the tools travel linearly through the well casing, debris is guided upwards through the channels. To align the brushes, each brush may include a protruding key on the front face (not shown) that mates with a notch or recess on the rear face (not shown) of the adjacent brush such that one brush is circumferentially offset with respect to the adjacent brush by the appropriate angle (e.g., 30 degrees) to align the channels. Those of ordinary skill in the art will realize that while three brushes are shown in FIG. 5, any number of brushes may be used to suit the particular conditions.

The brush is constructed by placing bundles of bristles equally on a circular tool in a teepee-like arrangement. This allows a solid retaining ring 15 to be forced over the bristle bundles until it reaches the approximate center point of the bundles. The inner retaining member 14 is then flared with a tool to force the bristles to fold around the retaining ring. A further folding of the inner member flattens the bristles against the retaining ring and creates the finished bristle ring 13.

As discussed above, the brush features channels extending from one face of the brush to the other. After the bristle ring is created, portions of the bristles are removed to create the channels that allow the debris to move through the brush. Alternatively, the channels may be formed by specific placement of the bristles in the inner retaining member.

It will be apparent to those skilled in the art that various modifications and variations can be made in the configuration of the present invention without departing from the spirit or scope of the invention. It is intended that the present invention cover such modifications and variations provided they come within the scope of the appended claims or their equivalents.

What is claimed is:

1. A brush for removing debris from a well bore casing, the brush comprising:

a cylindrical base ring having front and rear edges, an outer surface, and adapted to be affixed to well tools; and a plurality of bristle assemblies circumscribing the outer surface of the base ring, each bristle assembly including a plurality of bristles, the bristles extending radially outward from the bristle assembly, the bristles of the bristle assemblies forming a brushing surface having a front face and a rear face;

wherein a channel extends through the brushing surface from the front face to the rear face and having a depth extending radially inward from the brushing surface, the channel being substantially free of bristles; and wherein each bristle assembly includes an inner member having a channeled cross-section, and a retaining ring; and wherein each bristle has first and second ends, the bristles extending around the retaining ring so that a portion of each bristle is located between the inner member and the retaining ring, the retaining ring securing the bristles to the inner member at approximately their center, and wherein the ends of each bristle extend radially from the bristle assembly.

2. The brush of claim 1, wherein the channel extends from the first face to the rear face at a non-perpendicular angle to the front face.

3. The brush of claim 2, wherein the angle is approximately 30 degrees.

4. The brush of claim 1, wherein the brushing surface includes four channels.

5. The brush of claim 4, wherein each channel extends approximately 30 to 60 degrees around the circumference of the brushing surface from the front face to the rear face.

6. The brush of claim 1, wherein the percentage of the total of the brush circumference occupied by the channels is less than 50%.

7. The brush of claim 1, wherein the bristles are formed from wire.

8. The brush of claim 7, wherein the wire has a diameter of approximately 0.020 inch.

9. The brush of claim 1, wherein the bristles are formed from stainless steel wire.

10. The brush of claim 1, wherein the ends of each bristle extend approximately 1 inch from the bristle base.

11. A brush for removing debris from a well bore casing, the brush comprising:

a cylindrical base ring having front and rear edges, an outer surface, and adapted to be affixed to well bore tools;

a plurality of bristle assemblies circumscribing the outer surface of the base ring, each bristle assembly including a plurality of bristles, the bristles extending radially outward from the bristle assembly, the bristles of the bristle assemblies forming a brushing surface having a front face and a rear face, each bristle assembly including an inner member having a channeled cross-section, a retaining ring; and wherein each bristle has first and second ends, the bristles extending around the retaining ring so that a portion of each bristle is located between the inner member and the retaining ring, the retaining ring securing the bristles to the inner member at approximately each bristle's center, and wherein the first and second ends of each bristle extend radially outward from the bristle assembly; and a channel extends through the brushing surface from the front face to the rear face and having a depth extending radially inward from the brushing surface, the channel being substantially free of bristles, the channel extending from the first face to the rear face on an angle to the front face so as to form a generally helical path through the brushing surface.

12. The brush of claim 11, wherein the angle is approximately 30 degrees.

13. The brush of claim 11, wherein the brushing surface includes four channels.

14. The brush of claim 13, wherein each channel extends approximately 30 to 60 degrees around the circumference of the brushing surface from the front face to the rear face.

15. The brush of claim 11, wherein the percentage of the total of the brush circumference occupied by the channels is less than 50%.

16. A tool string assembly for testing and cleaning of a well bore casing, the string comprising a shaft and a brush assembly mounted to the shaft, the brush assembly including:

a cylindrical base ring having front and rear edges, an outer surface, the base being disposed about a portion of the shaft; and a plurality of bristle assemblies circumscribing the outer surface of the base ring, each bristle assembly including a plurality of bristles, the bristles extending radially outward from the bristle assembly, the bristles of the bristle assemblies forming a brushing surface having a front face and a rear face;

wherein a channel extends through the brushing surface from the front face to the rear face and having a depth extending radially inward from the brushing surface, the channel being substantially free of bristle; and wherein each bristle assembly includes an inner member having a channeled cross-section, and a retaining ring; and wherein each bristle has first and second ends, the bristles extending around the retaining ring so that a portion of each bristle is located between the inner member and the retaining ring, the retaining ring securing the bristles to the inner member at approximately their center, and wherein the ends of each bristle extend radially from the bristle assembly.

17. The tool string assembly of claim 16, wherein the angle is approximately 30 degrees.

18. The tool string assembly of claim 16, wherein the brushing surface includes a plurality of channels, and wherein each channel extends approximately 30 to 60 degrees around the circumference of the brushing surface from the front face to the rear face.

19. The tool string assembly of claim 16, wherein the percentage of the total of the brush circumference occupied by the channels is less than 50%.

* * * * *